US008529207B2

(12) United States Patent
Kalavsky

(10) Patent No.: US 8,529,207 B2
(45) Date of Patent: Sep. 10, 2013

(54) DYNAMIC PUMP WHEEL FOR A PUMP AND A PUMP DEVICE COMPRISING A DYNAMIC PUMP WHEEL

(75) Inventor: Michal Kalavsky, Kosice (SK)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 517 days.

(21) Appl. No.: 12/867,081

(22) PCT Filed: Feb. 11, 2009

(86) PCT No.: PCT/EP2009/051595

§ 371 (c)(1),
(2), (4) Date: Aug. 11, 2010

(87) PCT Pub. No.: WO2009/103647

PCT Pub. Date: Aug. 27, 2009

(65) Prior Publication Data

US 2010/0310378 A1 Dec. 9, 2010

(30) Foreign Application Priority Data

Feb. 19, 2008 (DE) ..... 10 2008 009 785

(51) Int. Cl.
*F04D 29/30* (2006.01)

(52) U.S. Cl.
USPC ..... 416/140; 416/142

(58) Field of Classification Search
USPC ..... 416/186 R, 186 A, 142, 143, 132 R, 416/136, 141, 205, 131, 31, 41, 43, 44; 415/129, 140, 146
See application file for complete search history.

(56) References Cited

U.S. PATENT DOCUMENTS

| | | | | |
|---|---|---|---|---|
| 2,383,001 | A * | 8/1945 | Mader | 416/132 R |
| 2,570,862 | A | 10/1951 | Rosenkrans et al. | |
| 3,033,015 | A | 5/1962 | Stutrud | |
| 3,272,129 | A * | 9/1966 | Leopold | 417/350 |
| 3,301,188 | A * | 1/1967 | Belonger | 415/198.1 |

(Continued)

FOREIGN PATENT DOCUMENTS

| | | | |
|---|---|---|---|
| CN | 2477870 | Y | 2/2002 |
| EP | 0166104 | B1 | 9/1989 |
| EP | 1070850 | A1 | 1/2001 |
| FR | 802966 | A | 9/1936 |
| GB | 528439 | A | 10/1940 |

OTHER PUBLICATIONS

International Search Report PCT/EP2009/05195.

(Continued)

*Primary Examiner* — Nathaniel Wiehe
*Assistant Examiner* — Kayla McCaffrey
(74) *Attorney, Agent, or Firm* — James E. Howard; Andre Pallapies

(57) ABSTRACT

A pump wheel for a pump has a base body that can be rotated about a rotational axis and on which at least one wing element is arranged for conveying a fluid during the rotation of the pump wheel. The pump wheel has a pivoting device by which the at least one wing element is mounted in such a way that it can pivot about a pivoting axis arranged at an angle larger than zero degrees in relation to the rotational axis of the pump wheel, according to a rotational direction, between an action position in which a conveyor pressure for the fluid can be generated, and an idle position in which there is essentially no conveyor pressure.

20 Claims, 5 Drawing Sheets

(56) References Cited

U.S. PATENT DOCUMENTS

| | | | | |
|---|---|---|---|---|
| 5,378,124 | A * | 1/1995 | Welch | 417/423.1 |
| 5,613,846 | A | 3/1997 | Sommer | |
| 2006/0083618 | A1 * | 4/2006 | Holt | 416/142 |

OTHER PUBLICATIONS

Report of Examination DE 10 2008 009 785.3.

National Search Report CN 200980105741.3 dated Dec. 18, 2012.

* cited by examiner

DYNAMIC PUMP WHEEL FOR A PUMP AND A PUMP DEVICE COMPRISING A DYNAMIC PUMP WHEEL

BACKGROUND OF THE INVENTION

FIELD OF THE INVENTION

The present invention relates to a pump wheel for a pump, comprising a base body that can be rotated about a rotational axis, to which at least one wing element is attached for conveying a fluid during a rotation of the pump wheel. In addition the present invention relates to a pump device with such a pump wheel.

Pump wheels of this type are already known from the prior art. They generally comprise a base body able to be rotated about a rotational axis as well as at least one, but usually a plurality of wing elements which are arranged on the base body and which are embodied to convey a fluid as the pump wheel is rotated. Also known from the prior art are pump wheels for which the at least one wing element is arranged movably on the base body. Thus publication U.S. Pat. No. 2,570,862 discloses a pump device with a pump wheel having a plurality of wing elements which are embodied from an elastic material, especially from rubber.

In addition publication EP 0166104 B1 discloses a centrifugal pump especially for washing systems in motor vehicles, which comprises an impeller embodied to turn in two opposite directions and which has wing elements. In this case each of the wing elements has a fixed part which defines a radial extent and an articulated part which opens in a first direction of rotation of the impeller or closes in a second opposing direction of rotation, so that in the first direction of rotation the wing elements have a first radial extent and in the second direction of rotation a second radial extent. The result achieved is that a different conveyor pressure for a fluid can be created as a function of the direction of rotation. A disadvantage of this centrifugal pump, depending on the application, lies in the fact that when turning in the second direction of rotation in which the opened parts of the wing elements are closed, a conveyor pressure effected by the fixed parts is still able to be created for the fluid.

BRIEF SUMMARY OF THE INVENTION

The object of the present invention is to create a pump wheel for a pump as well as a pump device in which measures are taken which guarantee that, when the pump wheel is turned in a first direction, a maximum conveyor pressure is able to be created, and when the pump wheel is turned in a second direction, a minimum conveyance pressure is able to be created.

This object is inventively achieved by a pump wheel with the features in accordance with claim 1, as well as by a pump device with the features in accordance with claim 23.

Advantageous embodiments of the invention are specified in the subclaims.

An inventive pump wheel for a pump comprises a base body able to be rotated about a rotational axis, on which at least one wing element is arranged for conveying a fluid when the pump wheel is rotated, with the pump wheel having a pivoting device by means of which the at least one wing element is supported about a pivoting axis arranged at an angle of greater than 0° to the rotational axis of the pump wheel, as a function of the direction of rotation, between an action position in which a conveyor pressure for the fluid is able to be created and an idle position in which there is essentially no conveyor pressure.

In other words an important idea behind the invention consists of a pivoting device being provided which is embodied such that the at least one wing element can be pivoted between an action position and an idle position about a pivoting axis arranged at angle of greater than 0°, especially at a right angle to the rotational axis of the pump wheel. The result achieved in an advantageous manner by the inventive pump wheel is that, with a rotational movement of the pump wheel in a first direction of rotation, a conveyor pressure for the fluid is able to be created and, with a rotational movement of the pump wheel in an opposite second direction, essentially no conveyor pressure for the fluid is able to be created.

In one form of embodiment there can be provision for the base body to be embodied in the form of a plate. Preferably the base body is embodied in the form of a disk.

The pivoting device is especially arranged in a radial direction on the disk-shaped base body in such a way that at least one wing element is coupled to the base body by means of the pivoting device along a radius of the disk-shaped base body.

In a preferred manner the at least one wing element lies in an idle position with a pressure surface in at least some areas on the base body. In addition there can be provision in a form of embodiment for the at least one wing element to be arranged in the idle position approximately in parallel to the base body. This guarantees that, for a rotational movement of the pump wheel in the second direction of rotation, no conveyor in pressure for the fluid or no friction force is able to be created and thus a greater efficiency is ensured. In particular the least one wing element in this form of embodiment has a flat pressure surface which is arranged in the idle position of the wing element in parallel to the base body. As an alternative the at least one wing element can also have a concave pressure surface, with in this form of embodiment the parallel arrangement of the wing element to the base body in the idle position able to be considered in a first approximation.

Preferably the least one wing element is arranged in the action position with a pressure surface at an angle of greater than 0° to the base body. If the at least one wing element has a flat pressure surface there can be provision for the least one wing element to be arranged in an action position at an angle of around 90° to the base body. If the pressure surface of the wing element is embodied concave, the least one wing element is arranged in the action position preferably at right angles to the base body in a first approximation.

In one form of embodiment there can be provision for the at least one wing element to have a concave pressure surface. This guarantees that the fluid is conveyed in a rotational movement of the pump wheel more reliably in the first direction of rotation and a greater conveyor pressure can be created.

Preferably the base body features a recess embodied on a side of the base body facing towards the wing element in which at least some areas of the wing element are able to be received in the idle position. In a preferred manner the at least one wing element is arranged completely recessed into the recess of the base body in the idle position. In particular the recess in the base body is embodied in a radial direction of the pump wheel open to the outside. Preferably a geometry of the recess of the base body is adapted to a geometry of the outer contour of the wing element. In particular there can be provision that the least one wing element to be completely recessed into the recess of the base body in the idle position and also be arranged flush with the base body. Thus a flush surface of the base body is embodied especially in the idle position. As an alternative there can be provision for the at least one wing element to be arranged recessed into the recess of the base body such that a sunken area is embodied between the surface of the base body and the surface of the wing element facing away from a pressure surface of the wing element or the at least one wing element is arranged recessed in the recess deeper than the surface of the base body.

In one form of embodiment the least one wing element is embodied in the form of a circle segment. In this case there can especially be provision for the recess of the base body to also be embodied in the form of a circle segment, which guarantees that the at least one wing element can be recessed into the recess.

Preferably the least one wing element has a projection to strike against a contact surface of the base body. The result achieved by this is that, in an action position, the at least one wing element can rest stably on the base body, especially on the support surface of the base body.

In particular the projection of the least one wing element is embodied as a nose or web lengthening an outer edge of the wing element.

In one form of embodiment there is provision for a space to be embodied in the idle position of the wing element between an outer contour of the projection of the wing element and a wall embodied by a recess in the base body, which forms a flow channel. This ensures that the space embodied between the projection and the wall of the base body enables the wing element to be quickly hinged open automatically by a flow pressure or a dynamic pressure of the fluid from the idle position into the action position. In particular the recess can be embodied such that the wall facing towards the projection or the outer contour of the projection of the wing element is arranged at an angle of greater than 0°, preferably at an angle of around 45° to the rotational axis of the pump wheel.

In a preferred form of embodiment there is provision for a cutout to be embodied on a contact side of the wing element facing towards the base body defining a pressure surface by means of which the wing element is able to be pivoted by a flow pressure of the fluid from the idle position into the action position. In particular the cutout of the wing element is embodied open to the outside in a radial direction of the pump wheel so that it can be guaranteed that a flow pressure of the fluid can effect a rapid and reliable pivoting open of the wing element into the action position. In particular a flow channel is embodied by the cutout of the wing element or is enlarged by a flow channel defined between an outer contour of the projection of the wing element and a space embodied by the wall embodied by a recess in the base body.

In a preferred manner the base body has a coupling device for coupling the pump wheel to the pump shaft arranged on the side of the base body facing away from the wing element. In particular there can be provision for the coupling device to have an annular or cylindrical projection part or coupling part defining a projection of the base body protruding or standing out from the base body which has an outer wall facing away from the rotational axis of the pump wheel as well as an inner side facing towards the rotational axis of the pump wheel. The inner side facing towards the rotational axis of the pump wheel can be embodied such that it has a surface exhibiting a structure. The structure is especially embodied as a regular structure over an entire circumference of the inner side of the projecting part or coupling part. The result achieved by this is that a pump shaft can be coupled in a technically simple torque-proof manner to the pump wheel. Preferably there is provision for the coupling device to also feature an opening in the base body of the pump wheel which defines an inner space of a hub element arranged facing away from the coupling device and facing towards the wing element.

Preferably the pivoting device has a groove arranged radially on the base body into which a pin-type part of the wing element extends and is supported rotatably therein. Preferably the groove is arranged on an outer edge of the base body. There can be provision for the groove to be embodied in the form of a cylinder segment and to be open to the outside in a direction defined by the rotational axis of the pump wheel. In particular the pin-type part of the wing element can be embodied such that a space is embodied at least in some areas between the wing element and the pin-type part in which an area of the groove extends depending on the position of the wing element.

In one form of embodiment there is provision for the base body to have a hub element on a side of the base body facing towards the wing element and protruding from the base body. In particular the hub element is arranged centrally on the base body. In a preferred manner the hub element features at least one cutout with a contact surface for a projection of the wing element to strike in the action position. The result achieved by this is the at least one wing element can rest stably on the hub element in the action position.

The base body and the at least one wing element are preferably embodied as separate components. In respect of production this enables the base body and the wing element to be manufactured separately and to be assembled together in one production step.

Preferably the pump is provided for a household appliance, especially for cleaning items of crockery.

An inventive pump device for a household appliance, especially for cleaning items of crockery, comprises at least two pump wheels, with at least one of the pump wheels being an inventive pump wheel.

Preferably the at least two pump wheels are held on a common pump shaft, with the least two pump wheels preferably being coupled torque-proof to the pump shaft.

In one form of embodiment there is provision for a first pump wheel to be embodied as a circulation pump and for a second pump wheel to be embodied as a drain pump in the household appliance.

In particular the pump device is embodied such that it has two pump wheels arranged on a common pump shaft, with one of the pump wheels being an inventive pump wheel. Preferably the two pump wheels are arranged on the pump shaft such that at least one wing element of the inventive pump wheel is arranged on a side facing away from the pump shaft and away from the second pump wheel. The pump device is preferably designed such that, with a rotational movement of the pump shaft, depending on the direction of rotation, only one pump wheel in each case generates a conveyor pressure for a fluid with no conveyor pressure of the fluid able to be generated by the other pump wheel. This is achieved by the inventive design of the pump wheel.

A further aspect of the present invention relates to a household appliance, especially for cleaning items of crockery, with an inventive pump device.

Further advantages, features and details of the invention emerge from the subsequent description of an exemplary embodiment as well as with reference to the drawings. The figures show:

DESCRIPTION OF THE INVENTION

Figure 2:
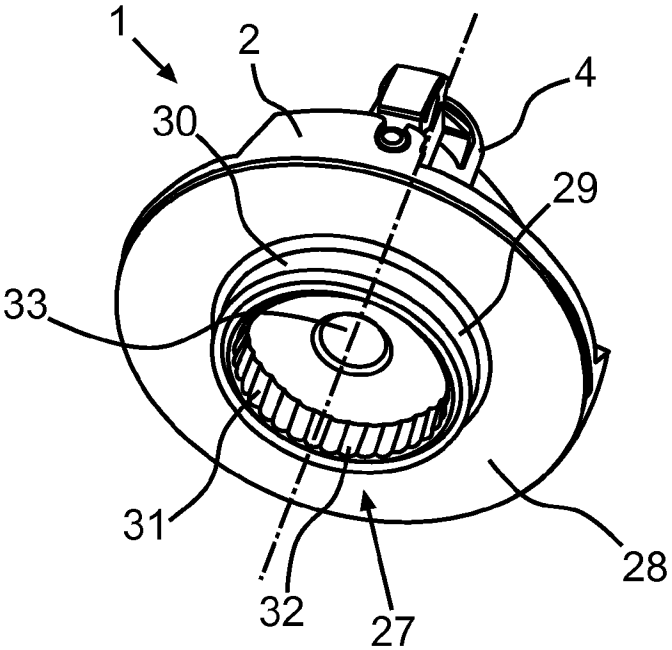
FIG. 2 the pump wheel with a coupling device arranged on the side of the pump wheel facing away from the wing element for coupling the pump wheel to a pump shaft.

Identical elements or elements with the same functions are provided with the same reference signs in the figures.

The exemplary embodiment explained in greater detail below represents a preferred form of embodiment of the present invention, with the invention not being restricted to the exemplary embodiment shown in the drawings. All features described below and presented in the drawings are able to be combined in numerous ways with each other.

Figure 1:
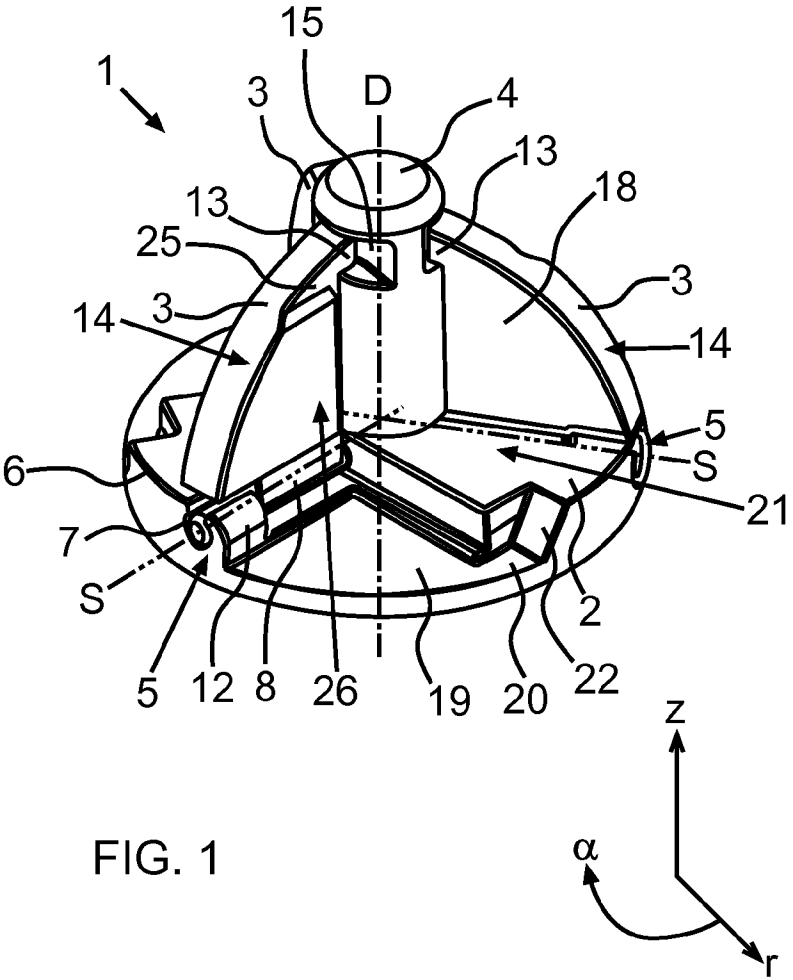
FIG. 1 a pump wheel in accordance with an embodiment of the present invention with a wing element in an action position.

A pump wheel 1 shown in FIG. 1 in accordance with a form of embodiment of the present invention comprises a base body 2 as well as three wing elements 3 arranged at an equal spacing from one another over the circumference of the base body 2. The pump wheel 1 is able to be moved rotationally around a rotational axis D (z direction).

To provide better orientation, the pump wheel 1 is based here on a cylindrical coordinate system with a radial direction r (at right angles to the z direction), and axial direction z and also an angular direction a (plane at right angles to the z direction).

In the present example the base body 2 is embodied in the form of a plate and in the form of a disk or in the form of a circle in a cross-section in the radial direction r. The pump wheel 1 has a hub element 4 arranged centrally on a side facing towards the wing elements 3 and projecting from the base body 2 in the axial direction z, which is embodied in the present example in the form of a column or of a cylinder.

Figure 4:
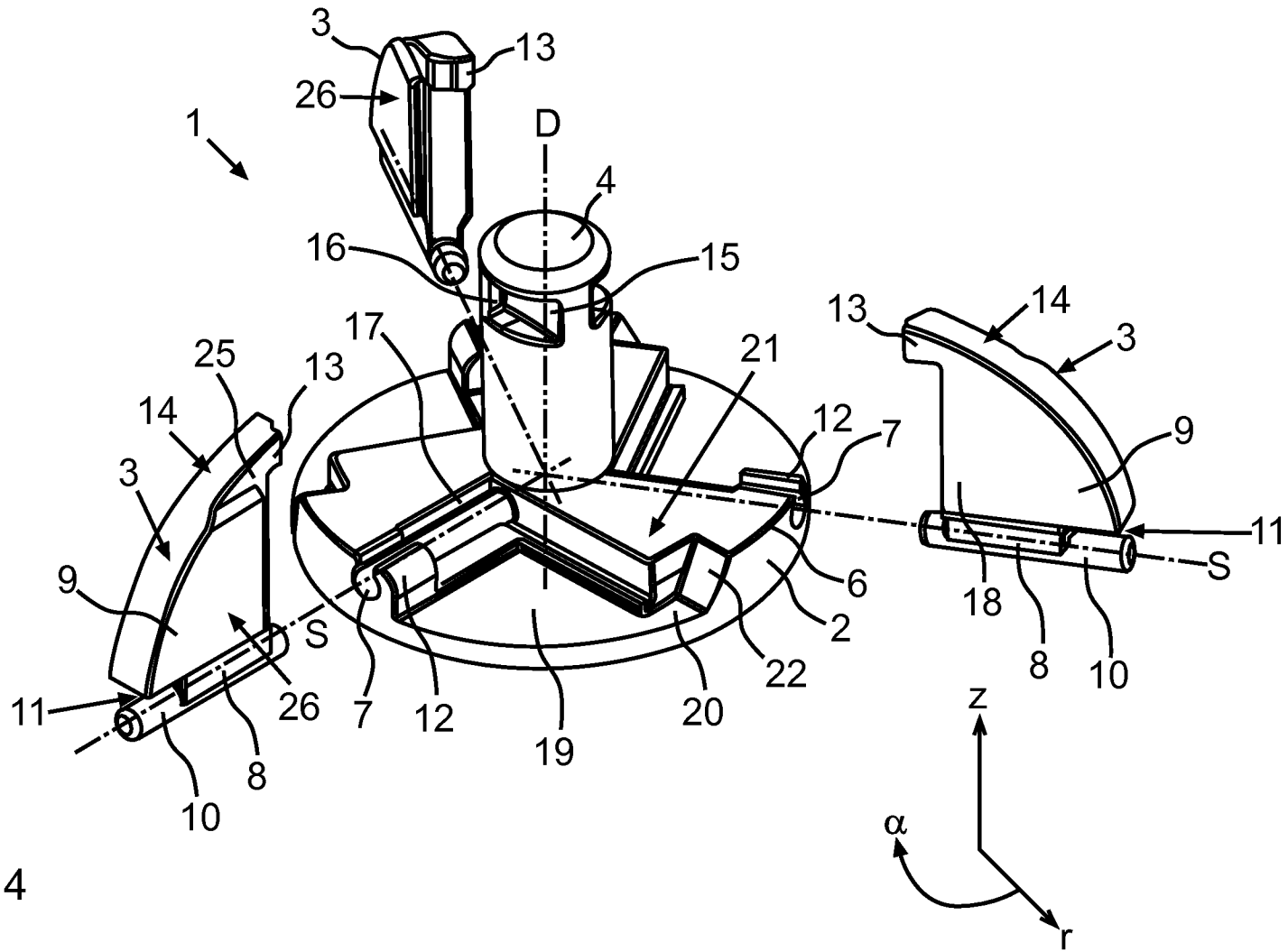
FIG. 4 the pump wheel with a base body and separately shown wing elements.

The pump wheel 1 further features a pivoting device 5 in each case for each wing element 3 by means of which the one respective wing element 3 in each case is pivotably supported between an action position shown in FIG. 1 and an idle position around a pivoting axis S arranged in the present example at right angles to the rotational axis D and extending in the radial direction r. The pivoting device 5 comprises a groove 7 extending in the radial direction r and arranged on an outer edge 6 of the base body 2 in the radial direction r into which a pin-type part 8 of the one wing element 3 in each case extends. At this point it should be mentioned that the base body 2 and the three wing elements 3 are embodied as separate components in the present example. Referring to FIG. 4, the pin-type part 8 of the one wing element 3 in each case is embodied such that between a base part 5 of the wing element 3 and a projection 10 of the pin type-part 8 a space 11 is embodied in which an area 12 of the groove 7 engages depending on the position of the pivotable wing element 3.

In the present example the wing elements 3 are embodied in the form of a circle segment or a sail. As already mentioned, the wing elements 3 are supported by means of the pivoting device 5 to enable them to pivot between an action position and an idle position about a pivoting axis S. To this end the wing elements 3 each have a projection 13 which is embodied in the example as a nose or a web lengthening the outer edge 14 of the one wing element 3 in each case. This projection 13 has the task of guaranteeing stability or a stable position of the wing element 3 in the action position. To this end the hub element 4 has a cutout 15 in each case for each wing element 3, in which a contact surface 16 (see FIG. 4) is embodied to strike the projection 13 of the wing element 3 in the action position. Thus the wing elements 3 are arranged in the action position at a right angle to the base body 2. In addition the base body 2 features a further contact surface 17 (see FIG. 4) against which an area of a surface 18 of the wing element 3 rests in the action position.

Figure 3:
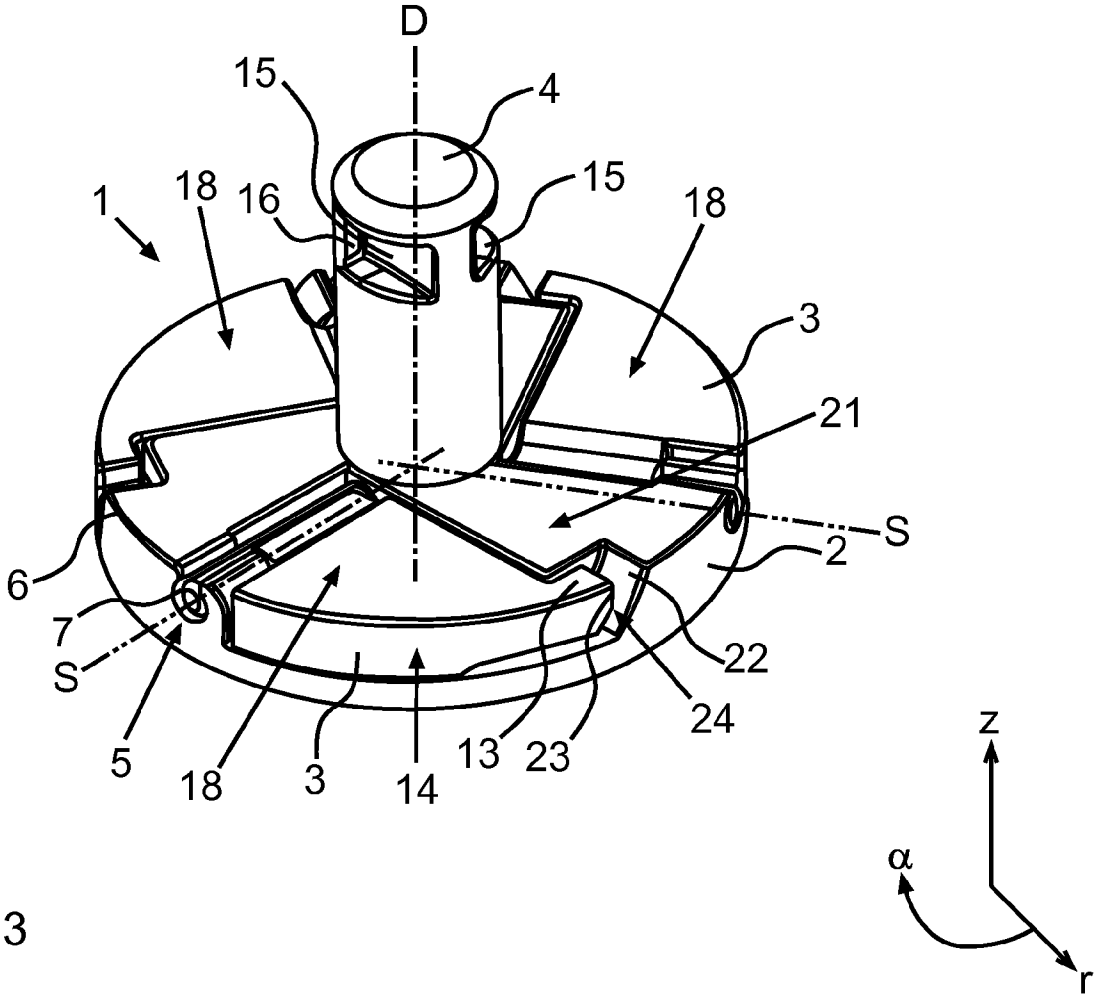
FIG. 3 the pump wheel with a wing element in an idle position.

The base body 2 has a recess 19 in each case for each wing element 3, into which the one wing element 3 in each case is able to be recessed in the idle position. The recess 19 in this case has a geometry adapted to a geometry of an outer contour of the wing element 3. Accordingly the recess 19 of the base body 2 is embodied in the form of a circle segment especially a quadrant, and additionally comprises an extension 20 adapted to the projection 13 of the wing element 3 and extending in the angular direction a and arranged on the outer edge 6 of the base body 2 in the radial direction r. Referring to FIG. 3, the recess 19 is embodied such that the surface 18 of the wing element 3, in the idle position shown in FIG. 3, is flush with a surface 21 of the base body 2. In addition the extension 20 of the recess 19 open outwards in the radial direction r is embodied such that between a wall 22 embodied by the recess 19 and especially by the extension 20 and an outer contour 23 of the projection of 13 of the wing element 3, a space 24 is embodied in the idle position. In addition each of the wing elements 3 has a cutout 25 on a side facing towards the projection 13 which is embodied as a recess or cutout of a pressure surface 26 facing away from the surface 18 of the wing element 3. A flow channel is embodied by the cutout 25 and the space 24 by means of which the one wing element 3 in each case can be opened out by a flow pressure or dynamic pressure of a fluid from the idle position into the action position when the pump wheel 1 rotates.

It should be pointed out at this point that the pressure surface 26 of the wing element 3 is embodied flat in this example, so that in the idle position this surface is arranged in parallel to the base body 2. As an alternative there can be provision for the wing elements 3 to have a curved concave pressure surface in each case, in which case a surface of the recess 19 can then be embodied curved.

Referring to FIG. 2, the pump wheel 1 also comprises a coupling device 27 by means of which the pump wheel 1 can be coupled to a pump shaft. The coupling device is arranged on a side 28 of the base body 2 facing away from one of the wing elements 3 and features an annular projecting part 29 extending from the base body 2 in the direction of the rotational axis D, which in the radial direction r has an outer wall 30 as well as an inner side 31. The inner side 31 of the projecting part 29 in this case has a regular structure 32 embodied over a circumference of the projecting part 29, which is embodied for supporting a corresponding structure of a wheel of the pump shaft and thus for torque-proof coupling of the pump wheel 1 to the pump shaft. The coupling device further comprises an opening 33 which defines an inner space of the hub element 4 and into which the pump shaft can be received.

Figure 6:
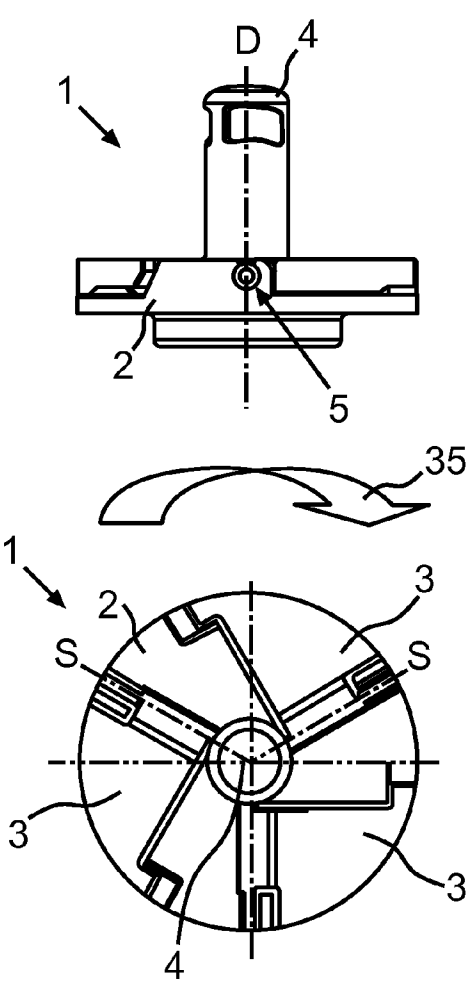
FIG. 6 a side view and also an overhead view of the pump wheel with the wing element in the idle position.
Figure 5:
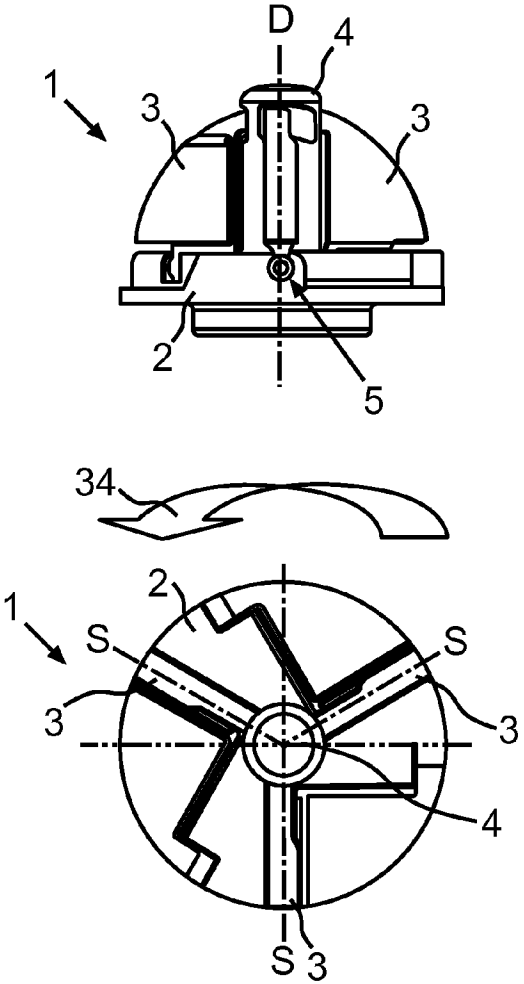
FIG. 5 a side view and also an overhead view of the pump wheel with the wing element in the action position.

The functioning of the pump wheel 1 is explained in greater detail below with reference to FIG. 5 and FIG. 6. FIG. 5 shows the pump wheel 1 with the wing elements 3 in the action position, with the pump wheel 1 with the wing elements 3 in the idle position being shown in FIG. 6. The object is to create a conveyor pressure for a fluid as the pump wheel 1 rotates in a direction shown by an arrow 34, whereby the conveyor pressure for the fluid is to be minimized when the pump wheel 1 is rotating in a second opposite direction shown by an arrow 35. To this end the wing elements 3 are able to be pivoted between the idle position depicted in FIG. 6 and the action position depicted in FIG. 5. Starting from the idle position of the wing elements 3, when the pump wheel 1 is stationary, the action of opening out the wing elements 3 will now be discussed. For this purpose the flow channel formed between the space 24 and the cutout 25 is shown to be particularly advantageous. If the pump wheel is moved rotationally in the first rotational direction, a flow pressure is created by a fluid by which the wing elements 3 will be automatically moved out of the idle position. The wing elements 3 are pivoted about the pivoting axis S until the projection 13 strikes the contact surface 16 of the cutout 15 of the hub element 4. If the projection 13 is against the contact surface 16 the full action position is reached. In this position a maximum conveyor pressure for the fluid is generated by the pump wheel 1. If on the other hand the pump wheel 1 is moved rotationally in the second direction of rotation, the wing elements 3 are pivoted by the flow pressure into the idle position so that no further conveyor pressure for the fluid is generated.

Figure 7:
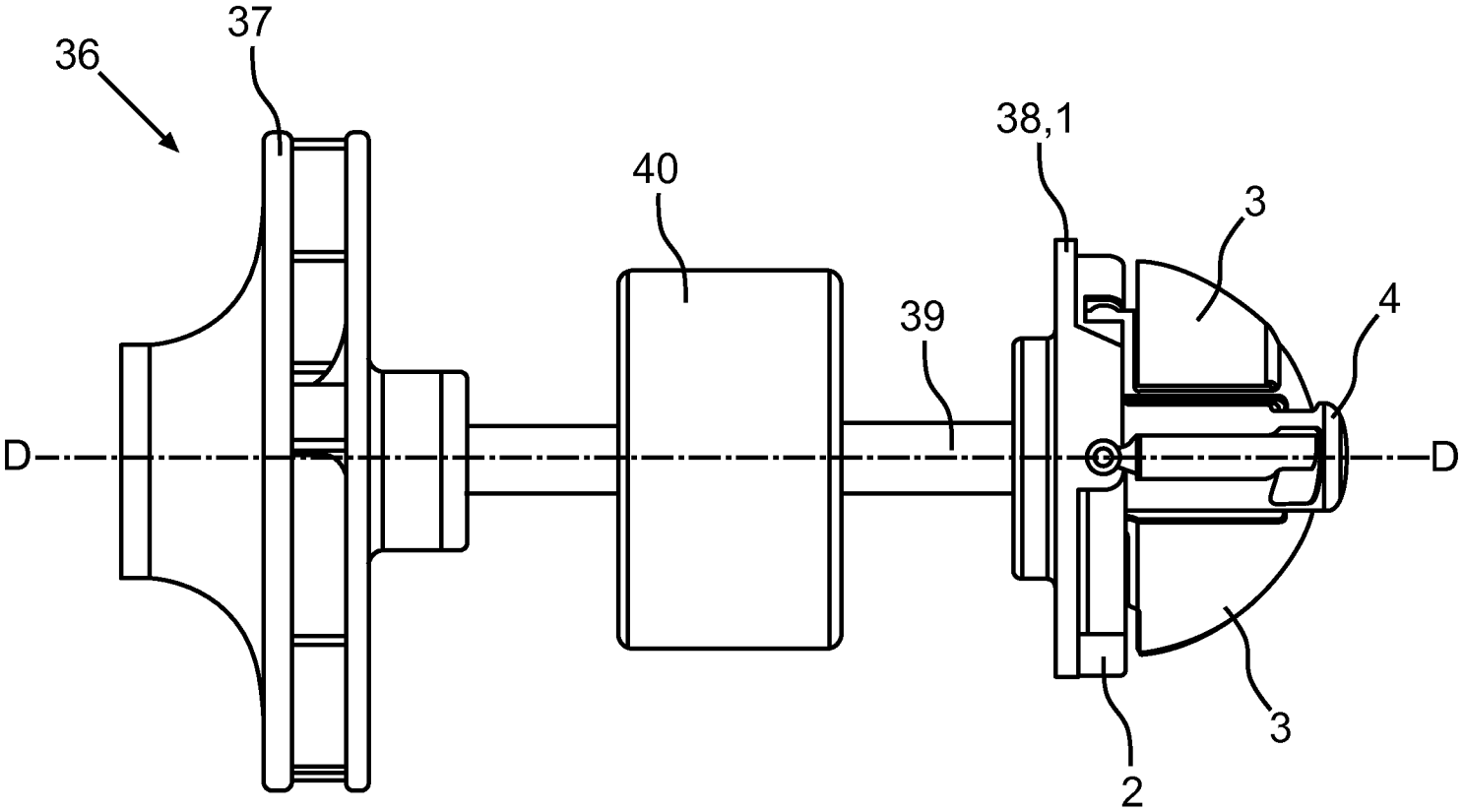
FIG. 7 a pump device according to an embodiment of the present invention with two pump wheels.

FIG. 7 shows a pump device 36 including two pump wheels 37, 38 and a pump shaft 39. The pump device 36 further comprises a rotor 40 which represents a part of an electric motor not shown in the figure. It should be pointed out that the pump wheel 38 is a pump wheel in accordance with the exemplary embodiment shown above. The first pump wheel 37 is embodied in this example as a circulation pump of the pump device 36 and the second pump wheel 38 as a drain pump of the pump device 36. What is of interest here is to minimize the conveyor pressure created by the second pump wheel 38 when the first pump wheel 37 is being used for circulation of the fluid. To this end the second pump wheel 38 is embodied such that, on rotation of the pump shaft 39 in a first direction during the circulation of the fluid, the wing elements 3 of the second pump wheel 38 are arranged in the idle position. The result achieved by this is that, when the first pump wheel 37 is used, no frictional force or no disruptive conveyor pressure is generated by the second pump wheel and thus an improved efficiency is achieved.

The invention claimed is:

1. A pump wheel, comprising:

a base body configured for rotation about a rotational axis, the base body having a pressure surface with a recess;

a hub element arranged centrally on and projecting from the base body, the hub element having a cutout;

a wing element which conveys a fluid when the pump wheel is rotated, wherein the wing element is pivotably movable about the base body between an action position in which the wing element strikes a surface of the cutout and an idle position in which at least some areas of the wing element are received by the recess such that the wing element strikes a surface of the base body.

2. The pump wheel of claim 1, wherein the wing element has a pressure surface which rests in the idle position on the pressure surface of the base body.

3. The pump wheel of claim 1, wherein the wing element is disposed in the idle position approximately parallel to the pressure surface of the base body.

4. The pump wheel of claim 1, wherein the wing element has a pressure surface which is disposed in the action position at an angle greater than zero degrees to the pressure surface of the base body.

5. The pump wheel of claim 1, wherein the wing element has a pressure surface which is disposed in the action position at an angle of around 90 degrees to the pressure surface of the base body.

6. The pump wheel of claim 1, wherein the wing element is disposed in the idle position fully recessed into the recess of the base body.

7. The pump wheel of claim 1, wherein the wing element has a projection which in the action position is received by the cutout of the hub element.

8. A pump wheel, comprising:

a base body configured for rotation about a rotational axis, the base body having a pressure surface with a recess and a groove;

a hub element arranged centrally on and projecting from the base body, the hub element having a cutout;

a wing element pivotable mounted at the groove for movement between an action position in which the wing element is received by the cutout and an idle position in which the wing element is received by and rests on the pressure surface of the base body, wherein in the idle position, a flow channel is created between the wing element and the surface of the recess which permits opening of the wing element by a flow pressure of the fluid from the idle position into the action position when the pump wheel rotates.

9. The pump wheel of claim 8, wherein the wing element is disposed in the idle position approximately parallel to the pressure surface of the base body.

10. The pump wheel of claim 8, wherein the wing element has a pressure surface which is disposed in the action position at an angle greater than zero degrees to the pressure surface of the base body.

11. The pump wheel of claim 8, wherein the wing element has a pressure surface which is disposed in the action position at an angle of around 90 degrees to the pressure surface of the base body.

12. The pump wheel of claim 8, wherein the wing element is disposed in the idle position fully recessed into the recess of the base body.

13. The pump wheel of claim 8, wherein the wing element has a projection which in the action position is received by the cutout of the hub element.

14. A pump wheel, comprising:

a base body configured for rotation about a rotational axis, the base body having a surface with a recess and a groove arranged radially on an outer edge of the base body;

a hub element arranged centrally on and projecting from the base body, the hub element having a cutout;

a wing element received by and pivotable mounted at the groove for movement between an action position in which the wing element strikes a surface of the cutout and an idle position in which the wing element is received by and rests on the surface of the recess, wherein in the idle position, a flow channel is created between the wing element and the surface of the recess which permits opening of the wing element by a flow pressure of the fluid from the idle position into the action position when the pump wheel rotates.

15. The pump wheel of claim 14, wherein the wing element is disposed in the idle position approximately parallel to the pressure surface of the base body.

16. The pump wheel of claim 14, wherein the wing element has a pressure surface which is disposed in the action position at an angle greater than zero degrees to the pressure surface of the base body.

17. The pump wheel of claim 14, wherein the wing element has a pressure surface which is disposed in the action position at an angle of around 90 degrees to the pressure surface of the base body.

18. The pump wheel of claim 14, wherein the wing element is disposed in the idle position fully recessed into the recess of the base body.

19. The pump wheel of claim 14, wherein the wing element has a projection which in the action position is received by the cutout of the hub element.

20. A pump device for a household appliance, the pump device comprising:

a pump shaft;

first and second pump wheels respectively coupled to the pump shaft, each pump wheel comprising:

a base body configured for rotation about a rotational axis, the base body having a pressure surface with a recess and a groove;

a wing element pivotable mounted at the groove for movement between an action position and an idle position in which the wing element is received by and rests on the pressure surface of the base body, wherein during rotation of the pump shaft in a first direction, the wing element of the first pump wheel is placed in the action position permitting circulation of the fluid while the second wheel is placed in the idle position.

* * * * *